US005191727A

United States Patent [19]

Barry et al.

[11] Patent Number: 5,191,727

[45] Date of Patent: * Mar. 9, 1993

[54] PROPULSION PLATE HYDRODYNAMIC FOOTWEAR

[75] Inventors: Daniel T. Barry, Ann Arbor; Raymond M. Fredericksen; Robert W. Soutas-Little, both of Okemos; Ruk R. Peterson, Grand Rapids, all of Mich.

[73] Assignee: Wolverine World Wide, Inc., Rockford, Mich.

[ * ] Notice: The portion of the term of this patent subsequent to Oct. 1, 2008 has been disclaimed.

[21] Appl. No.: 743,483

[22] Filed: Aug. 8, 1991

Related U.S. Application Data

[63] Continuation-in-part of Ser. No. 510,671, Apr. 18, 1990, Pat. No. 5,052,130, which is a continuation-in-part of Ser. No. 131,309, Dec. 8, 1987, abandoned, which is a continuation-in-part of Ser. No. 942,245, Dec. 15, 1986, abandoned.

[51] Int. Cl.[5] ..... A43B 13/18; A43B 13/12; A43B 13/24

[52] U.S. Cl. ..... 36/107; 36/28; 36/29; 36/114

[58] Field of Search ..... 36/114, 107, 108, 28, 36/30 R, 27, 76 C, 31, 102, 140, 154, 173, 178, 181

[56] References Cited

U.S. PATENT DOCUMENTS

| | | | |
|---|---|---|---|
| 75,900 | 3/1868 | Hale et al. . | |
| 180,819 | 8/1876 | Ames . | |
| 634,588 | 10/1899 | Roche . | |
| 872,615 | 12/1907 | Eastman | 36/25.2 |
| 898,951 | 9/1908 | Zooboavch . | |
| 1,751,990 | 3/1930 | Gilkerson | 36/28 |
| 1,907,136 | 5/1933 | Weitsen . | |
| 2,049,604 | 8/1936 | Cristallini . | |
| 2,185,993 | 10/1937 | Haskell . | |
| 2,330,398 | 9/1943 | Vass . | |
| 2,475,417 | 1/1947 | Wysowski | 128/80 |
| 3,039,207 | 9/1955 | Lincors | 36/58.5 |
| 3,835,558 | 9/1974 | Revill | 36/44 |
| 4,081,917 | 4/1978 | Bradley et al. | 36/76 |
| 4,231,169 | 10/1980 | Toyama et al. | 36/43 |
| 4,360,027 | 10/1982 | Friedlander et al. | 128/581 |
| 4,378,642 | 4/1983 | Light et al. | 36/30 R |
| 4,404,757 | 9/1983 | Sweeny | 36/107 |
| 4,439,934 | 4/1984 | Brown | 36/44 |
| 4,454,662 | 6/1984 | Stubblefield | 36/91 |
| 4,463,505 | 8/1984 | Duclos | 36/30 |
| 4,481,726 | 11/1984 | Phillips | 36/30 |
| 4,486,964 | 12/1984 | Rudy | 36/28 |
| 4,492,046 | 1/1985 | Kosova | 36/27 |
| 4,510,700 | 4/1985 | Brown | 36/44 |

(List continued on next page.)

FOREIGN PATENT DOCUMENTS

| | | |
|---|---|---|
| 5601173 | 10/1974 | Austria . |
| 3126301 | 1/1983 | Fed. Rep. of Germany . |
| 3318181 | 10/1984 | Fed. Rep. of Germany . |
| 475731 | 11/1952 | Italy . |
| 12550 | 3/1907 | United Kingdom . |

OTHER PUBLICATIONS

"The Spring in Your Step," by R. McNeill Alexander, *New Scientist*, Apr. 30, 1987.

"Shoes with Rebound Effect Soles," *American Journal of Physiological Medicine*, p. 37, Feb. 1987.

*Primary Examiner*—Steven N. Meyers

*Attorney, Agent, or Firm*—Price, Heneveld, Cooper, DeWitt & Litton

[57] ABSTRACT

An athletic shoe having a hydrodynamic heel insert pad in the midsole to above a specially configurated spring plate which extends beneath the medial but not the lateral portion of the heel, through the arch region, to and beneath the metatarsal head region and toe region, serving to eliminate the force spike at heel impact in combination with foot control as the foot proceeds via complex movements through the gait cycle, and efficient toe off.

22 Claims, 3 Drawing Sheets

U.S. PATENT DOCUMENTS

| | | | |
|---|---|---|---|
| 4,520,581 | 6/1985 | Irwin et al. | 36/88 |
| 4,534,124 | 8/1985 | Schnell | 36/114 |
| 4,542,598 | 9/1985 | Misevich et al. | 36/114 |
| 4,597,195 | 7/1986 | Dananberg | 36/28 |
| 4,598,486 | 7/1986 | Olivieri | 36/96 |
| 4,612,713 | 9/1986 | Brown | 36/44 |
| 4,615,126 | 10/1986 | Mathews | 36/102 |
| 4,628,621 | 12/1986 | Brown | 36/44 |
| 4,651,445 | 3/1987 | Hannibal | 36/103 |
| 4,768,295 | 9/1988 | Ito | 36/28 |
| 4,774,954 | 10/1988 | Ibrahim | 128/581 |
| 4,815,221 | 3/1989 | Diaz | 36/27 |
| 4,854,057 | 8/1989 | Misevich et al. | 36/114 |
| 4,858,338 | 8/1989 | Schmid | 36/44 |
| 4,878,300 | 11/1989 | Bogaty | 36/35 |
| 4,934,072 | 6/1990 | Fredericksen et al. | 36/29 |
| 5,052,130 | 10/1991 | Barry et al. | 36/114 |
| 5,097,607 | 3/1992 | Fredericksen | 36/29 |

PROPULSION PLATE HYDRODYNAMIC FOOTWEAR

RELATED APPLICATION

This application is a continuation-in-part application of pending U.S. application Ser. No. 510,671, filed Apr. 18, 1990, entitled SPRING PLATE SHOE, which is a continuation-in-part application of U.S. application Ser. No. 131,309, filed Dec. 8, 1987, entitled SHOE WITH SPRING-LIKE SOLE MEMBER, which is a continuation-in-part MEMBER. This application is also related to application Dec. 15, 1986, entitled SHOE WITH SPRING-LIKE SOLE MEMBER. This application is also related to application Ser. No. 742435, filed Aug. 8, 1991, and entitled TEAR DROP PROPULSION PLATE FOOTWEAR.

BACKGROUND OF THE INVENTION

This invention relates to footwear, and particularly to athletic footwear.

In copending application Ser. No. 510,671, is disclosed footwear incorporating a special propulsion plate extending from the medial portion of the heel through the arch to a position forwardly of the metatarsal heads. This construction has been found highly effective in cooperating with the spring energy of the natural biomechanism of the foot, storing energy and then releasing the energy in response to flexure during each step. This specially configurated plate is formed of layers of oriented fibers, normally carbon (graphite) fiber, embedded in polymer and enclosed between the midsole and the outsole.

The midsole for athletic shoes is typically formed of a foam polymer such as expanded EVA ethylene vinyl acetate polymer (EVA).

In U.S. Pat. 4,934,072, entitled FLUID DYNAMIC SHOE, is set forth a special pad inserted in the heel region of the midsole.

SUMMARY OF THE INVENTION

In this invention, the spring plate in the midsole extending from beneath the medial portion of the heel region, through the arch region, up to and beneath the toe region, is combined with a fluid dynamic pad above the spring plate in the heel region. The spring plate is tapered in the rear to extend primarily beneath the medial portion of the heel region, and not significantly beneath the lateral portion of the heel region, leaving the lateral heel area directly in engagement with the midsole. The dynamic pad extends over both the medial and lateral heel areas, so that the medial part of the pad extends over the plate, but the lateral part of the pad does not extend over the plate. The interaction of these components results in excellent foot control while eliminating the force spike of heel impact shock. The flexible resilient spring member has a predetermined flexure characteristic and is arranged to flex with the sole of the shoe in the region of the ball of the foot of the human wearer during each step. The resilient member accommodates the natural movement of the foot, and cooperates uniquely with the natural spring action of the foot biomechanism and the action of the dynamic heel insert above the spring member. The spring plate and dynamic insert cushion and also stabilize the foot, as well as store and release energy in response to flexure during each step.

The spring plate has elongated parallel fibers in each layer, bonded within a polymer, and arranged at an acute angle relative to the longitudinal axis of the shoe. The layers are coupled together by polymeric bonding. The fibers in the layers are oriented in composite symmetry relative to this longitudinal axis. The spring plate has anisotropic stiffness, with greater stiffness longitudinally than laterally.

In the preferred embodiment of the invention, the material which forms the flexible resilient member is of carbon fiber-reinforced epoxy in a plurality of even number layers.

Each layer of fiber-reinforced polymeric material has a flexure characteristic which is directional resulting from the orientation of the parallel reinforcing fibers within the material. Typically, such material can withstand greater forces, such as bending forces, in the direction of the fiber orientation, than transverse thereto. The various layers of fiber-reinforced material which form the flexible resilient member each have a directional aspect to the respective flexure characteristic. Such layers are arranged so that the directions of fiber orientation are at predetermined respective angles to one another. In this manner, the longitudinal and transverse flexure characteristics of the flexible resilient member can be tailored for a specific activity in which the human wearer is expected to engage. The flexible resilient member may be curved in a manner which conforms to the sole of the shoe. For example, the flexible resilient member may be curved upward in the region of the front of the shoe, as well as having a curvilinear spring arch on the bottom of the shoe.

In accordance with the invention, the flexible resilient plate member cooperates with the dynamic fluid pad in the heel region to achieve heel impact absorption, foot stability and control, longer midsole life, and rapid toe off. The flexible resilient member functions as a spring, while the outer sole, and particularly the heel subassembly, operate as a damping and spring-back medium. The midsole and inner sole can also function as supplemental damping media. A damping medium may assist in reducing one or more oscillation modes of the shock wave produced in a runner's leg by the impact at foot strike and also may assist in tuning the system for the particular running characteristics of the wearer. Similarly, the cushioning material in the heel region can serve to dampen oscillations.

Another important object of the invention is to provide a novel shoe having cooperative action between the specially configurated spring plate and a dynamic viscous fluid insert.

The novel combination is considered particularly effective in a performance running shoe.

DETAILED DESCRIPTION OF THE PREFERRED EMBODIMENT

Modern athletic type shoes achieve markedly superior characteristics over those of some years ago. Much of this improvement is due to the sole assembly, particularly the midsole features. In action, the foot proceeds through the gait cycle from the initial, large, impact force spike to ultimate toe off, performing the gait by a remarkably complex foot action which has been shown to ultimately result in breakdown of the midsole structure in certain areas. This breakdown occurs somewhat gradually, such that foot control is gradually lost, resulting in overpronation, oversupination and/or other undesirable results.

The present invention employs a combination which cooperatively functions to largely eliminate the heel impact spike, alleviate loss of foot control, stabilize the foot from heel impact to toe off, and extend the useful life of the midsole and the footwear.

Figure 7:
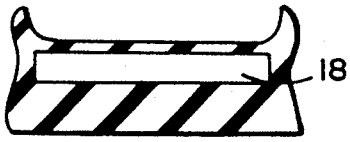
FIG. 7 is a sectional view taken on plane VII—VII of FIG. 3.

A runner will typically contact the ground with a vertical ground reaction force of approximately 2.5 to 3.0 times his/her body weight. Examination of the vertical force plot reveals there are actually two maximum load peaks. The first peak occurs very rapidly and is associated with initial foot impact The second, more slowly rising peak is associated with foot propulsion as the heel is lifted off the ground and load is shifted to the metatarsal heads of the forefoot. Also, during the contact phase, a runner will exhibit a braking and propulsive ground reaction force that will coincide with the vertical force. The third ground reaction force component is a medial-lateral force associated with the internal and external rotation of the foot and leg. These three vector force components are illustrated in FIG. 7 of copending application Ser. No. 510,671 referenced above.

A runner typically contacts the ground heel first, usually on the lateral portion of the heel, with the foot in a rigid supinated position. Immediately after contact, the foot switches from a rigid structure to a mobile one, as it pronates to attenuate the ground reaction forces associated with heel strike. At maximum midstance pronation, the foot then resupinates and the arch of the foot is returned to a rigid structure to allow for stable propulsion at toe off. The motion sequence of pronation and supination of the foot is the body's natural mechanism for attenuating impact shock and storing potential energy for propulsion. The novel shoe herein effects impact cushion at heel strike, stability and control during the gait cycle, and spring action toe off. In achieving these characteristics, it employs a combination full length spring plate and dynamic fluid heel pad, especially in combination with a viscous foam midsole.

In the heel region to the rear of the propulsion plate is the viscous fluid pad bladder of U.S. Pat. No. 4,934,072, housed in a cavity of the midsole. The midsole is made of a cellular viscous polymer. The propulsion plate herein is an elastic unit of particular configuration.

The propulsion plate consists of multiple layers of polymer and fibers, preferably carbon fibers, placed in specific alignment to each other. Each layer consists of unidirectional, i.e., parallel, carbon fibers preferably preimpregnated in a resin, preferably an epoxy resin. By changing the alignment of fibers in the adjacent layers relative to each other, the stiffness and bending characteristics of the plate can be adjusted.

The length of the plate spans substantially the entire length of the midsole. The plate extends from the medial heel zone, forwardly through the arch region and sufficient to underlie the metatarsals and toes. The plate terminates a small amount from the front and heel ends of the midsole to prevent the rather sharp edges of the plate from cutting anything or anyone, and to allow adequate adhesive area between the overlying midsole and the underlying outsole in these areas. The width of the rearfoot stability component is narrowed by being tapered so as to be substantially more narrow at the rearfoot region than the midsole, sloping to underlie the medial area but not a significant portion of the lateral area of the heel. Above this lateral area of the spring plate is the rear chamber of the dynamic fluid insert pad bladder to be described. The plate and bladder in this lateral area are separated by a thin portion of the cellular midsole. The structure effects rearfoot stability with effective impact absorption at heel strike.

It is significant that human connective tissue is not only sensitive to the magnitude of the force applied, but also to the rate in which it is applied. The rearfoot stability provides smooth transition from heel strike to midstance. The velocity and degree of pronation are controlled while at the same time shock is attenuated and potential energy is stored. As the heel is lifted off the ground, energy is released from the spring plate and assists in bending the forefoot propulsion plate while the load is transferred to the metatarsal heads. Then, throughout the toe off phase, energy stored in the forefoot plate is released to provide propulsion into the next stride. It is important to allow sufficient bending and recoil during the loading and propulsion phase of gait.

Preferably, four layers of embedded carbon fiber are placed at 60° alignment relative to each other in the rear region of the plate. In the heel tail portion, the arch portion and up to the metatarsal breakline, the thickness and stiffness may be greater than forwardly of the breakline. The composite of layers is symmetrical relative to the fibers. That is, if one layer has its fibers at an angle of 30° to the longitudinal axis at one side of the axis, another layer will be at an angle of 30° to the axis on the other side. The result is symmetry. This fiber alignment and stiffness is preferred in order to efficiently attenuate heel shock and control the rapid velocity of rearfoot pronation. The specific angle of the fibers may be varied from 60° to tune the shoe to particular activities and/or persons. Also, the number of layers and consequent stiffness can be varied for tuning purposes. The metatarsal breakline of the foot is typically at an average angle of about 60° relative to the longitudinal axis of the shoe. Forwardly of the metatarsal heads the propulsion plate may taper to two layers to facilitate forefoot flexibility. The four layer portion and two layer portion would have an integral interface juncture therebetween. If a person has sensitive metatarsal heads, it may be desirable to have the juncture a small amount behind the breakline, and even to incorporate a metatarsal bar. Some tempering may be needed in the arch area to avoid too rapid uncoiling of the plate. This tempering is readily effected, for example, by the change to less thickness, i.e., two layers in the forefoot plate compared to four layers in the other portions, and by the symmetrical arrangement of the parallel fibers at angles to each other in successive layers.

This invention takes advantage of the fact that as a person runs, the arch of the foot plays a key role in attenuating impact shock and in storing potential energy to be used for propulsion. The function of the arch of the foot has in the past been likened to a spring. The arch "coils down" as the foot flattens during pronation to attenuate impact shock. At the same time it stores potential energy and then "springs back" as the foot resupinates during the propulsion phase. The spring-like mechanism of the foot is due to the truss-like structure of the arch of the foot, and the elastic characteristics of human connective tissue, i.e., muscle, tendon, bone and ligament. Human connective tissues store and release energy as they stretch and contract, something like rubber bands. The propulsion plate and dynamic fluid bladder work synergistically with the natural spring mechanism of the foot and the function of the viscoelastic midsole to provide more efficient running biomechanics.

Referring now specifically to the drawings, an illustrative embodiment incorporating the invention is disclosed in the form of an athletic shoe 10 having an upper 12 secured to a sole subassembly 13.

Figure 1:
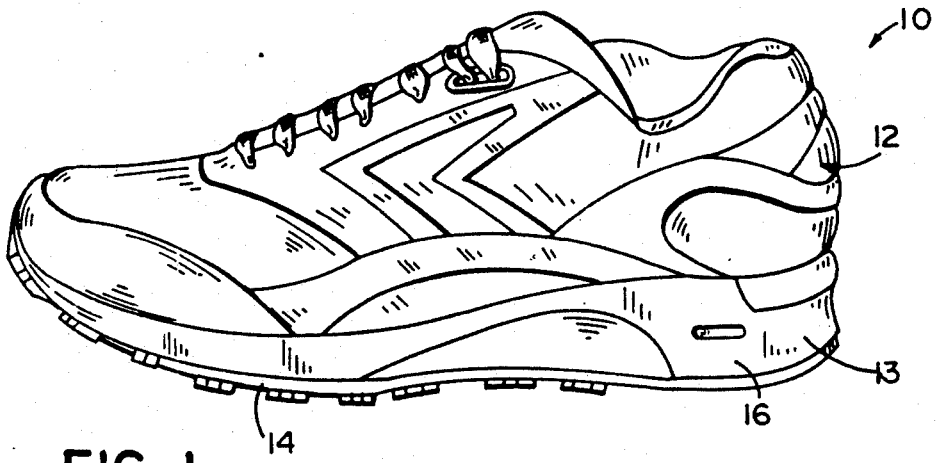
FIG. 1 is a perspective view of the lateral side of the left shoe of the novel construction.
Figure 2:
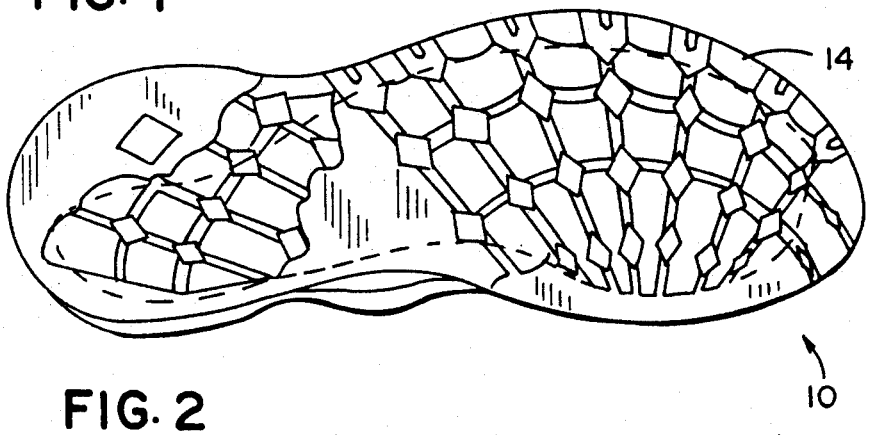
FIG. 2 is a bottom perspective view of the novel shoe.
Figure 9:
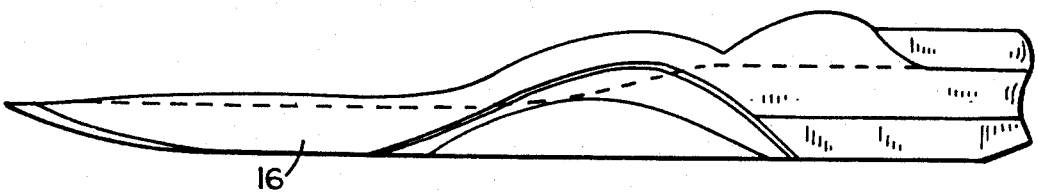
FIG. 9 is an elevational view of the medial side of the sole subassembly.

The upper may be of a variety of configurations and/or constructions such as those well known in the art. The upper is secured to the sole assembly by stitching and/or adhesive, using any of a variety of well known techniques. The sole subassembly comprises an outer sole 14, a midsole 16, a specially configurated spring plate 17 between the outer sole and midsole, and a viscous fluid pad 18 in a like shaped recess of the midsole heel portion. The outer sole is formed of conventional abrasion resistant material such as rubber, the heel part of the outsole optionally being of a higher durometer material than the remainder of the outsole. FIG. 1 depicts the outsole extending up over the midsole and a portion of the upper at the toe to inhibit toe scuffing, in conventional fashion.

Midsole 16 is formed of a conventional viscous elastic material such as foam ethylene vinyl acetate polymer (EVA), polyurethane (PU), or other viscoelastic, polymeric, expanded, cellular material The heel area of the midsole has a cavity which contains the dynamic viscous fluid structure 18 disclosed in U.S. Pat. 4,934,072, issued Jun. 19, 1990, entitled Fluid Dynamic Shoe, and incorporated herein by reference. Spring plate 17 is bonded between the midsole and outsole, terminating just short at the front end, the rear end and the side edges of the midsole. The midsole 16, spring plate 17 and outsole 14 are bonded to each other by a suitable adhesive such as those typically used in the shoe trade. The finished shoe may also include a conventional inner sole and sock liner (not shown).

The specific structure of the spring plate illustrated, as previously noted, is of multiple layers of polymer embedded elongated fibers, preferably carbon fibers, (otherwise designated graphite fibers), so as to be embodied by the polymer matrix, preferably of an epoxy resin. Each individual layer has the fibers therein extending in the same direction, i.e., to be basically parallel to each other, the fibers being laid side-by-side. The individual layers are bonded to each other. In the preferred embodiment, one layer is arranged relative to the adjacent layer to cause the fibers to be at an acute angle to each other of about 60°, plus or minus about 10°, i.e., about 30° relative to the longitudinal axis of the shoe sole assembly. There is normally an even number of layers, preferably four, so that the total grouping of fibers constitutes a symmetrical arrangement and flexing action. The outer top and bottom layers preferably have the fibers oriented diagonally forwardly toward the medial side since this creates a slight forward bias toward the lateral side during toe off. The fibers in this angular arrangement also create an anisotropic stiffness, with greater stiffness longitudinally than laterally of the sole. The spring plate has flexibility with inherent memory to return it to its original molded configuration.

As noted, one arrangement is to have four layers in the portion of the plate in the heel region, the arch region and up to about the metatarsal breakline, merging integrally into two layers forwardly of the metatarsal breakline and under the toes. Another arrangement is to have the same number of layers, preferably four, throughout the length of the spring plate.

Figure 3:
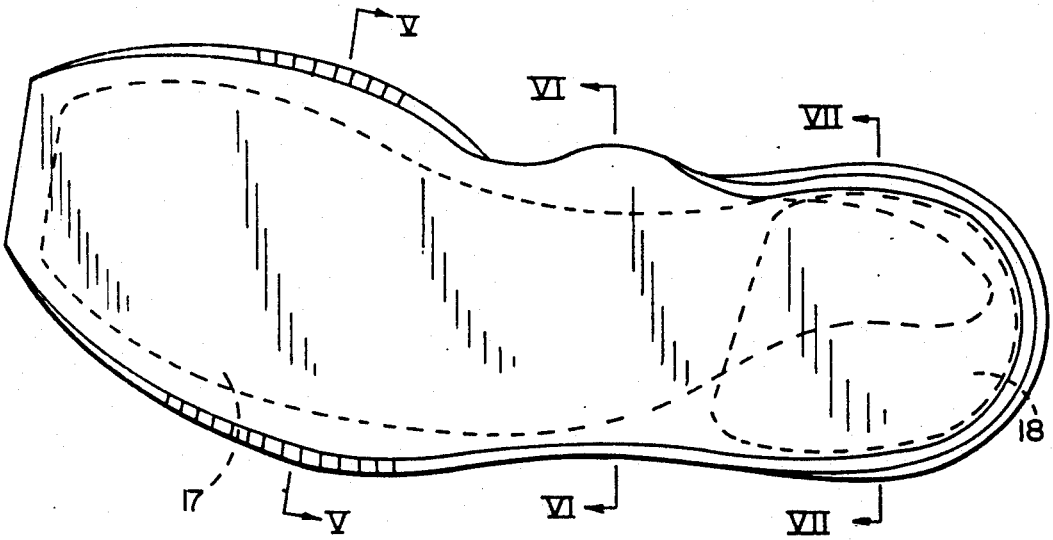
FIG. 3 is a top plan view of the sole subassembly for the novel shoe.
Figure 4:
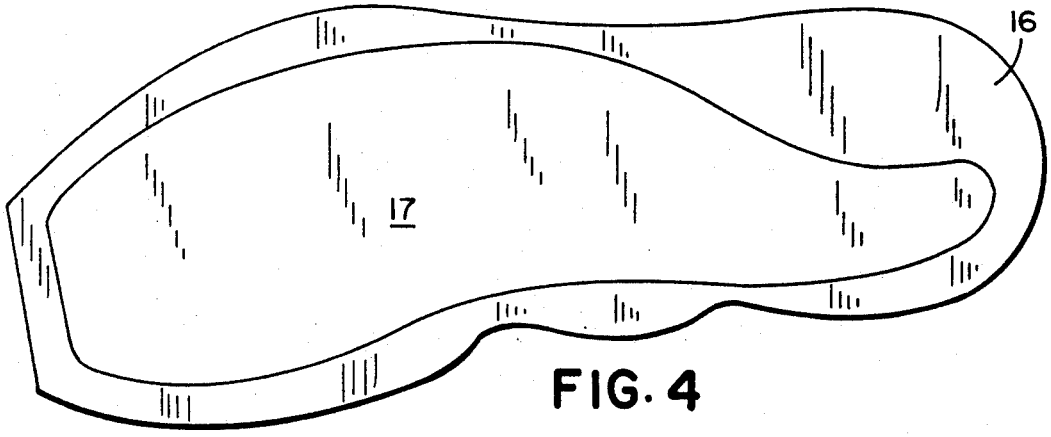
FIG. 4 is a bottom view of the midsole with the propulsion plate therein.
Figure 5:
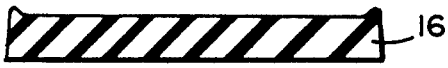
FIG. 5 is a sectional view taken on plane V—V of FIG. 3.
Figure 6:
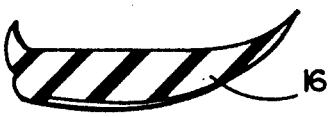
FIG. 6 is a sectional view taken on plane VI—VI of FIG. 3.
Figure 8:
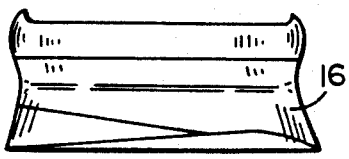
FIG. 8 is a rear elevational view of the sole subassembly.

The configuration of the spring plate is depicted in FIGS. 3 and 4, showing the spring plate relative to the outline of the midsole and its relationship to the heel pad bladder. The spring plate tapers to include a relief beneath the lateral portion of the heel but extends substantially beneath the medial side of the heel. Thus, at heel strike, typically on the outer, i.e., lateral, portion of the heel, the runner has the benefit of the full cushioning and shock absorption effect of dynamic fluid member 18 as well as the viscous midsole layer below member 18, but immediately acquires stability and foot control characteristics as well as the energy return of the dynamic insert and the spring plate as the foot moves through the gait cycle.

Figure 11:
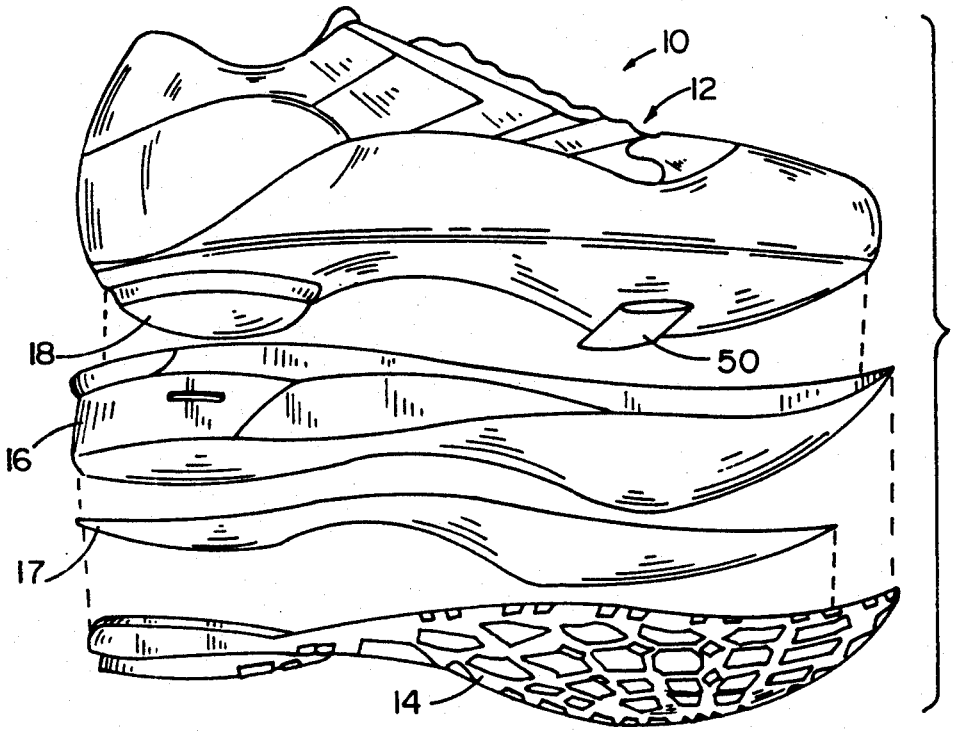
FIG. 11 is an exploded perspective view of the shoe.
Figure 12:
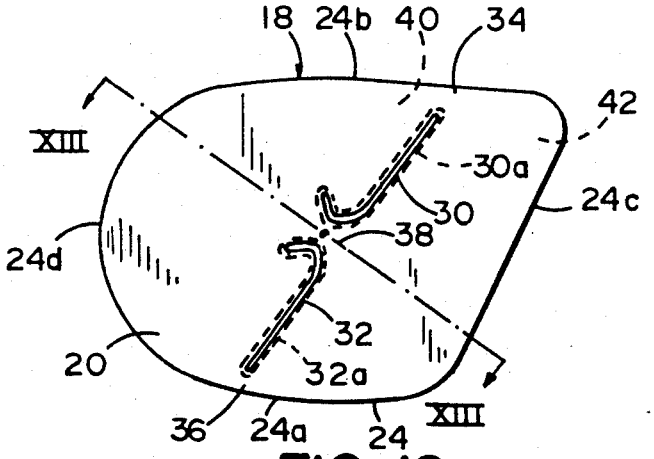
FIG. 12 is a plan view of the fluid dynamic heel insert bladder.
Figure 13:
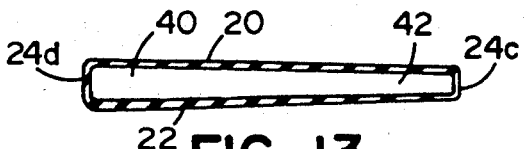
FIG. 13 is a sectional view taken on plane XIII—XIII of FIG. 12.
Figure 14:
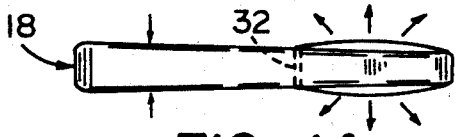
FIG. 14 is a side elevational view of the inert bladder, shown with pressure applied to its rear chamber as occurs during heel strike, causing the front heel chamber to bulge.

Under the metatarsal joint line is optionally positioned a viscoelastic pad insert 50 (FIG. 11) as of SORBOTHANE TM or the like.

In the rear of the midsole is the bladder structure 18 depicted in outline in FIG. 3. It forms a viscous pad which lies above the heel portion of the spring plate 17 and specifically above the medial heel portion of the plate, the lateral portion of the pad not having spring plate beneath it. The bladder structure 21 is formed of a flexible polymeric material, preferably polyethyl vinyl acetate, or polyurethane, or the equivalent, having a wall thickness of approximately 1-2mm and including an upper wall 20, a lower wall 22 spaced from the upper wall, and a peripheral wall 24 comprising a medial sidewall **24*a*, a lateral sidewall 24*b*, a diagonal front wall 24*c* and a convexly curved rear wall 24*d*. Front wall 24*c*** is at an angle of about 25° to a line transverse to the unit, with the lateral wall being longer than the medial wall. The peripheral wall is integrally joined with the upper and lower walls to form an enclosed space or chamber. It has been determined that the height of the bladder body should be about 10mm at the thickest, i.e., the rear, portion thereof, tapering toward the forward end to about 7mm. This taper in the bladder from rear to front assists in causing bulging in the front chamber upon heel impact, enabling rapid subsequent return flow of liquid to the rear chamber, the front chamber being smaller than the rear chamber.

Intermediate these two extremities, therefore, the height is approximately 8 to 8½mm. Since the polymeric material forming the bladder is preferably approximately 1mm thick, the height of the openings 34, 36 and 38 thus is approximately 4 to 6½mm, for an overall cross sectional area of 16 to 26 sq. mm for each passageway. Preferably the height and width of each of the three is 4mm. The total area of the three orifices forming the passage means is about 48 to 78 sq. mm. The orifices should comprise 10 to 25 percent of the total cross sectional divider area between the front and rear chambers. If the ratio of flow opening is too large, or too small, the pad will tend to undesirably act solely like a spring. The pad also may taper from a greater thickness at the medial portion to a lesser thickness at the lateral portion.

An integral interior diagonal control wall structure extends across the enclosed space of the pad. This is formed by two J-shaped, mirror image elongated vertical openings 30 and 32 through the thickness of the insert, including the upper wall and lower wall, to form adjacent wall members. This may be achieved by placing transverse J-shaped core members in the mold when forming the bladder such that a double wall 30*a* and 32*a* is formed adjacent each of these J-shaped openings 30 and 32 as indicated by the dotted lines in FIG. 3. The curved ends of these J-shaped openings are adjacent to and spaced from each other and curve convexly toward each other to form a venturi therebetween. The main straight portions of these J-shaped elements extend diagonally across the chamber, colinearly with each other, leaving an opening at the outer ends, i.e. between the outer ends of the control wall and the lateral and medial sidewalls. The walls therefore define three flow control orifices or openings 34, 36 and 38 therebetween for viscous fluid flow control or gate means as explained hereinafter. The lateral side opening 34, the medial side opening 36 and the central opening 38 are each preferably 3 to 4mm in width when employing a silicone fluid having a viscosity of about 1000 centistokes. The height of each opening is about 6 ½mm.

As noted previously, most persons have heel first contact. Further, persons who have heel first contact typically strike at the lateral rear corner of the heel, with a subsequent foot strike line of stress or center of pressure extending diagonally toward the midpoint of the heel and then longitudinally forwardly during foot roll to ultimate toe off from the great toe. The diagonal control wall structure separates the sealed space underlying the heel into a rear heel chamber 40 and a front heel chamber 42. The control wall extends at an angle basically normal to the foot strike line of stress experienced by most persons (basically between the dots along the left outer half of the phantom line in FIG. 3 of U.S. Pat. 4,934,072). The control wall is thus at an angle of about 35° to a line transverse of the heel, and about 55° to a longitudinal line bisecting the heel structure.

Rear heel chamber 40 is purposely caused to be substantially larger in volume than front heel chamber 42 by location of the wall and taper of the structure. Optimally, rear heel chamber 40 comprises 60 percent of the total volume, while front heel chamber 42 comprises 40 percent of the total volume. The quantity of viscous liquid in the total space is greater than the volume of front heel chamber 42. The amount of viscous liquid is preferably sufficient to fill approximately 80 to 90 percent of the total volume, leaving 10 to 20 percent for a gas such as air. It is important to always have a significant quantity of liquid in the rear heel chamber at the time of heel impact. This is aided by having an amount of total viscous liquid greater than the volume of the front heel chamber. This is also aided by having the front or forward chamber walls resiliently flexible to bulge, such that momentarily the amount of fluid in the forward chamber is greater than the at-rest volume of the front chamber, thereby creating part of the return bias force on the liquid due to the memory of the polymer. Additional return bias force is caused by momentary compression of air in the front chamber with forced flow of the liquid into that chamber. Further, the tapered construction enables the rear chamber to have the desired greater volume as previously noted.

Figure 10:
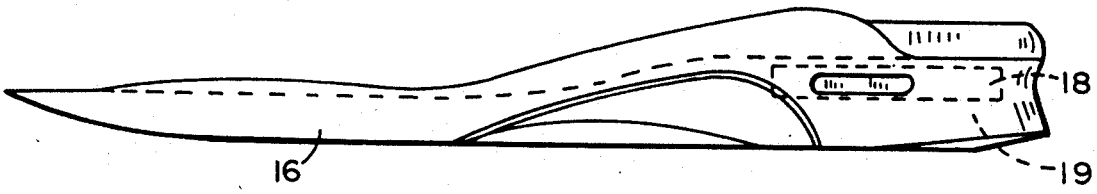
FIG. 10 is an elevational view of the lateral side of the sole subassembly.

Silicone fluid is preferably employed in this bladder because it is temperature stable, viscosity constant and nontoxic, as well as an excellent dampener. The viscosity employed is preferably about 1000 centistokes for an orifice to wall ratio factor in the range of 10 to 25 percent, preferably about 20 percent. The preferred range of viscosity is 1000 to 1250 centistokes. Above 1250 it tends to become too viscous for optimum forward and return flow actions. Below about 800, it tends to be too fluid for normal running events of an average sized person in the structure depicted. If the lower viscosity liquid is employed, the area of flow through the control wall should be decreased also, and vice versa. Between pad 18 and the underlying spring plate at the medial portion of the heel is a layer 19 of midsole material (FIG. 10). On the lateral side of the heel, this layer is between pad 18 and the outsole 14.

In action, as the typical runner's heel strikes at the junction of the lateral side and the convex rear wall, and moves along the strike line of stress diagonally forwardly toward the center of the heel, the top wall of the rear chamber is flexibly depressed so that the silicone liquid is forced under pressure through the three flow control orifices to the front heel chamber in a controlled manner. Increased liquid in forward chamber 42 causes the forward chamber walls, particularly its top wall 20, to temporarily resiliently bulge, thereby creating a return pressure. As the foot strike line of stress moves to the center and then forwardly, the strike impact is attenuated, decreasing the peak force load considerably from what it would otherwise be, and extending the time period of the strike load. This occurs entirely beneath the heel. Simultaneously, force is applied to the rear of the spring plate. The spring plate underlying the medial portion of the dynamic pad does not detract from this function of the pad, and yet supplies foot stability almost immediately after impact. As the foot proceeds through its typical foot roll and toe off stages of the gait, pressure is released from the rear heel chamber, pressure is momentarily applied to the top of the front heel chamber, and the bulging resilient wall of the front heel chamber applies further pressure, so that pressurized fluid in the front heel chamber flows back through the three orifices into the rear chamber as the foot bears down on the arch. As the heel begins to lift, the ground reaction force is shifted through the arch and then onto the metatarsals. As this occurs, the plate continues to control foot movement to stabilize the foot, as well as flexing to store spring energy. As the foot proceeds up onto the great toe, the strike line of stress advances, with concomitant further flexing of the symmetrical plate to store more energy. At toe off, the energy is returned from the plate, preferably in a forwardly outwardly biasing orientation relative to the foot, for smooth, rapid toe off.

Although the invention has been described in terms of specific preferred embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention and show the preferred embodiment thereof, and should not be construed to limit the scope thereof.

The embodiments of the invention in which an exclusive property or privilege is claimed are defined as follows:

1. An athletic shoe comprising an upper, and a sole assembly attached to said upper;

said sole assembly comprising an outsole, a midsole and a spring plate therebetween, said sole assembly having a heel region with a lateral portion and a medial portion, an arch region and a forefoot region which includes a metatarsal head region and a toe region;

said spring plate extending from beneath the medial portion of the heel region of said shoe, through the arch region of said shoe to and beneath the metatarsal head region and toe region of said shoe;

said spring plate in said heel region extending primarily beneath the medial portion of said heel region and not significantly beneath the lateral portion of said heel region, leaving the lateral portion of said outsole in said heel region in engagement with the lateral portion of said midsole in said heel region;

said midsole having a cavity in said heel region;

a fluid dynamic pad in said cavity extending in both said medial and said lateral portions of said heel region, above said spring plate in said medial region but not said lateral region.

2. The athletic shoe in claim 1 wherein said spring plate has an upwardly convexly configurated arch at said arch region, being compressible downwardly under force.

3. The athletic shoe in claim 1 wherein said spring plate has anistropic stiffness, with greater stiffness longitudinally than laterally.

4. The athletic shoe in claim 1 wherein said spring plate comprises bonded polymeric layers having elongated fibers arranged at an acute angle relative to the longitudinal center axis of said shoe, and oriented in composite symmetry relative to the center longitudinal axis.

5. The athletic shoe in claim 4 wherein said spring plate slopes away from beneath said lateral portion of said heel region.

6. The athletic shoe in claim 1 wherein said spring plate has parallel elongated fibers arranged at an acute angle relative to the longitudinal center axis of said shoe, and oriented in composite symmetry relative to the center longitudinal axis;

said spring plate being of anisotropic stiffness, with a greater stiffness longitudinally than laterally.

7. The athletic shoe in claim 1 wherein said midsole comprises a foam polymer, and said midsole includes a layer of said foam polymer between said fluid dynamic pad and said lateral portion of said spring plate in said heel region.

8. The athletic shoe in claim 7 including a pad of visoelastic material at said metatarsal head region.

9. The athletic shoe in claim 1 wherein said pad comprises:

a bladder having an upper wall, a lower wall spaced from said upper wall and a peripheral wall joining said upper and lower walls, including a medial side wall and a lateral side wall connected by a front wall and merging into a rear wall, said walls defining a sealed space therebetween;

an interior control wall between said upper and lower walls and extending diagonally generally toward said medial and lateral sidewalls, dividing said space into a front heel chamber and a rear heel chamber;

said interior control wall being transverse to the foot strike line of stress that extends from the area of merger of said lateral sidewall and said curvilinear rear wall, diagonally toward the center of said space;

a viscous liquid and gas mixture filling said chambers;

at least said upper wall being flexible to allow front heel chamber volume expansion under pressure to a volume greater than the at-rest volume thereof;

said interior control wall having restrictive gate means allowing controlled dynamic flow of said viscous liquid between said chambers for controlled flow from said rear heel chamber to said front heel chamber during initial heel strike and to also cause front chamber volume expansion for impact attenuation and cushioning during heel strike, and for return flow from said expanded front heel chamber to said rear heel chamber during foot roll.

10. The shock responsive heel structure in claim 9 wherein said interior control wall is generally normal to the foot strike line of stress.

11. The shock responsive heel structure in claim 10 wherein said restrictive gate means comprises flow orifices.

12. The shock responsive heel structure in claim 11 wherein said rear heel chamber has a greater volume than said front heel chamber, and said viscous liquid is greater in volume than the volume of said front heel chamber.

13. The shock responsive heel structure in claim 12 wherein said front heel chamber has a volume of about 40 percent and said rear heel chamber has a volume of about 60 percent of the combined volume of both.

14. The shock responsive heel structure in claim 12 wherein said viscous liquid and gas mixture comprises 80 to 90 percent viscous liquid and 20 to 10 percent gas.

15. The shock responsive heel structure in claim 9 wherein said heel structure tapers from a greater height at the rear to a lesser height at the front thereof.

16. A shoe sole assembly for an athletic shoe comprising an outsole, a midsole and a spring plate therebetween, said sole assembly having a heel region with a lateral portion and a medial portion, an arch region and a forefoot region which includes a metatarsal head region and a toe region;

said spring plate extending from beneath the medial portion of said heel region, through said arch region, to and beneath said metatarsal head region and toe region;

said spring plate in said heel region extending primarily beneath the medial portion of said heel region and not significantly beneath the lateral portion of said heel region, leaving the lateral portion of said outsole in said heel region in engagement with the lateral portion of said midsole in said heel region;

a fluid dynamic pad in said midsole extending in both said medial and said lateral portions of said heel region, over said spring plate in said medial region but not in said lateral region;

said pad comprising a compressible rear chamber and an elastic front chamber separated by a wall with restricted orifice means therein for regulating fluid flow between said chambers;

said chambers having fluid therein;

said rear chamber being compressible upon heel impact to eliminate the sharp impact force spike, and cooperative with action of said spring plate which stabilizes the foot and assists toe off in the gait cycle.

17. The athletic shoe in claim 16 wherein said spring plate comprises bonded polymeric layers having elongated fibers arranged at an acute angle relative to the longitudinal center axis of said shoe, and oriented in composite symmetry relative to the center longitudinal axis.

18. The athletic shoe in claim 16 wherein said spring plate slopes away from beneath said lateral portion of said heel region.

19. The athletic shoe in claim 16 wherein said midsole comprises a foam polymer, and said midsole includes a layer of said foam polymer between said fluid dynamic pad and said lateral portion of said spring plate in said heel region.

20. The athletic shoe in claim 16 wherein said pad comprises:

a bladder having an upper wall, a lower wall spaced from said upper wall and a peripheral wall joining said upper and lower walls, including a medial side wall and a lateral side wall connected by a front wall and merging into a rear wall, said walls defining a sealed space therebetween;

an interior control wall between said upper and lower walls and extending diagonally generally toward said medial and lateral sidewalls, dividing said space into said front heel chamber and a rear heel chamber;

said interior control wall being transverse to the foot strike line of stress that extends from the area of merger of said lateral sidewall and said curvilinear rear wall, diagonally toward the center of said space;

said fluid comprising a viscous liquid and gas mixture filling said chambers;

at least said upper wall being flexible to allow front heel chamber volume expansion under pressure to a volume greater than the at-rest volume thereof;

said restricted orifice means allowing controlled dynamic flow of said viscous liquid between said chambers for controlled flow from said rear heel chamber to said front heel chamber during initial heel strike and to also cause front chamber volume expansion for impact attenuation and cushioning during heel strike, and for return flow from said expanded front heel chamber to said rear heel chamber during foot roll.

21. The shock responsive heel structure in claim 16 wherein said rear heel chamber has a greater volume than said front heel chamber, and said viscous liquid is greater in volume than the volume of said front heel chamber.

22. The shock responsive heel structure in claim 16 wherein said heel structure tapers from a greater height at the rear to a lesser height at the front thereof.

* * * * *